US008449783B2

(12) United States Patent
Watanabe

(10) Patent No.: US 8,449,783 B2
(45) Date of Patent: May 28, 2013

(54) METHOD OF MANUFACTURING LIQUID EJECTION HEAD SUBSTRATE

(75) Inventor: Keiji Watanabe, Oita (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/545,370

(22) Filed: Jul. 10, 2012

(65) Prior Publication Data

US 2013/0026130 A1 Jan. 31, 2013

(30) Foreign Application Priority Data

Jul. 29, 2011 (JP) ..... 2011-166494

(51) Int. Cl.
*H01B 13/00* (2006.01)

(52) U.S. Cl.
USPC ..... 216/27; 216/67; 438/21; 438/706

(58) Field of Classification Search
USPC ..... 216/27, 17; 438/21, 706
See application file for complete search history.

(56) References Cited

U.S. PATENT DOCUMENTS

| | | | | |
|---|---|---|---|---|
| 5,658,471 | A * | 8/1997 | Murthy et al. | 216/27 |
| 6,036,874 | A * | 3/2000 | Farnaam | 216/27 |
| 6,171,510 | B1 * | 1/2001 | Lee | 216/27 |
| 8,177,988 | B2 | 5/2012 | Komiyama et al. | |

FOREIGN PATENT DOCUMENTS

| | | | |
|---|---|---|---|
| EP | 764533 | A2 * | 3/1997 |
| JP | 9-123468 | A | 5/1997 |
| JP | 2009-61665 | A | 3/2009 |

* cited by examiner

*Primary Examiner* — Binh X Tran
*Assistant Examiner* — David Cathey, Jr.
(74) *Attorney, Agent, or Firm* — Fitzpatrick, Cella, Harper & Scinto

(57) ABSTRACT

A liquid ejection head substrate is manufactured by forming a wiring pattern on one surface of a substrate, forming an etching mask layer on the other surface of the substrate, forming a positioning reference mark on the etching mask layer by means of a laser, forming an opening pattern groove running through the etching mask layer and having a bottom in the inside of the silicon substrate, using the positioning reference mark, and forming a liquid supply port running through the silicon substrate by etching the silicon substrate from the opening pattern groove to the one surface by means of crystal anisotropic etching.

7 Claims, 7 Drawing Sheets

METHOD OF MANUFACTURING LIQUID EJECTION HEAD SUBSTRATE

BACKGROUND OF THE INVENTION

1. Field of the Invention

The present invention relates to a method of manufacturing a substrate to be used for a liquid ejection head such as an inkjet recording head adapted to eject ink toward a recording medium and form an image on the surface of the recording medium.

2. Description of the Related Art

Inkjet recording heads of the type adapted to eject ink from an ejection port formed above an ink ejection pressure energy generating element are conventionally known as liquid ejection head. A technique of forming an ejection energy generating element on the front surface of a substrate and supplying ink to an ejection port from the rear surface of the substrate has been adopted for inkjet recording heads of this type.

Japanese Patent Application Laid-Open Publication No. 2009-61665 discloses a method of manufacturing an inkjet recording head substrate of the above identified type by forming blind holes of two different types by means of a laser and subsequently forming an ink supply port by means of anisotropic etching. Japanese Patent Application Laid-Open Publication No. H09-123468 discloses a method of forming a positioning reference mark for machining by irradiating light to and thereby discoloring a resin layer (photoresist layer).

A method of using a positioning reference mark is conceivable for forming an ink supply port at a predetermined position by means of the manufacturing method described in Japanese Patent Application Laid-Open Publication No. 2009-61665. Then, blind holes of two different types can be formed highly accurately. However, when a positioning reference mark is formed by the method disclosed in Japanese Patent Application Laid-Open Publication No. H09-123468, light is irradiated onto a resin layer to reduce the optical transmittance of the resin layer and thereby discolor the resin layer. Therefore, when a silicon substrate has an inorganic material layer (inorganic layer) of Si, SiO, $SiO_2$, or Poly-Si, a resin layer needs to be formed on the inorganic material layer before applying the method of Japanese Patent Application Laid-Open Publication No. H09-123468. Then, a large number of steps are required to form a positioning reference mark.

SUMMARY OF THE INVENTION

Thus, the object of the present invention is to provide a method of manufacturing a liquid ejection head substrate that can form a positioning reference mark with a small number of steps even on a silicon substrate having an inorganic material layer at the back surface (second surface) and accurately produce a liquid supply port in the substrate in a short period of time.

According to the present invention, the above object is achieved by providing a method of manufacturing a liquid ejection head substrate including a step of forming a liquid supply port extending from a second surface to a first surface of a silicon substrate, the method including: a step of forming a wiring pattern on the first surface; a step of forming an etching mask layer on the second surface; a mark forming step of forming a positioning reference mark on the etching mask layer by using a laser from above the etching mask layer on the second surface; a laser machining step of forming an opening pattern groove running through the etching mask layer on the second surface and having a bottom in the inside of the silicon substrate, using the positioning reference mark; and a step of forming a liquid supply port running through the silicon substrate by etching the silicon substrate from the opening pattern groove to the first surface by means of crystal anisotropic etching.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

A liquid ejection head substrate that is obtained according to the present invention can be employed as a substrate to be used for an ejection head for ejecting ink, a liquid chemical, an adhesive agent, solder paste, etc. In the following, the present invention will be described by paying attention to inkjet recording heads adapted to be mounted in inkjet recording apparatus such as inkjet printers. Note, normally, a number of liquid ejection head substrates each having a liquid supply port are prepared from a single silicon substrate (silicon wafer).

Figure 1:
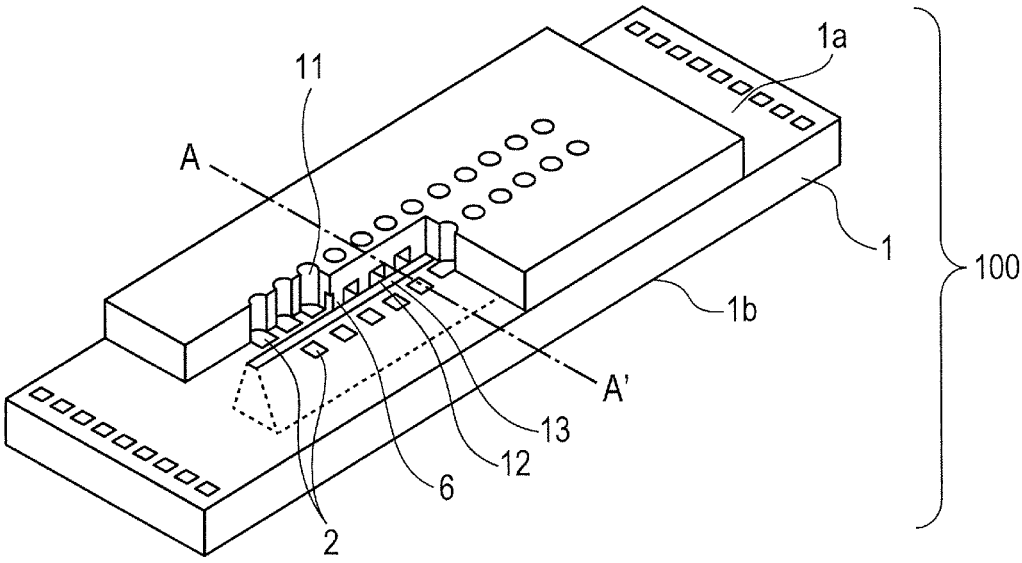
FIG. 1 is a schematic perspective view of an exemplar inkjet recording head prepared by using a substrate obtained by means of the present invention, illustrating the configuration of a principal part thereof.

FIG. 1 is a schematic perspective view of an exemplar inkjet recording head prepared by using a liquid ejection head substrate obtained according to the present invention, illustrating the configuration of a principal part thereof. The configuration of the principal part will be described in detail hereinafter.

The inkjet recording head (chip) 100 illustrated in FIG. 1 includes an inkjet recording head substrate (head substrate) 1 that is a liquid ejection head substrate obtained according to the present invention and an organic film layer 6.

The organic film layer 6 includes an ink ejection port (liquid ejection port) 11 for ejecting ink and an ink channel (liquid channel) 12 communicating with the ink ejection port. As illustrated, the organic film layer that operates as a channel wall and an ejection port wall can be made to have a plurality of ink ejection ports 11 and the corresponding number of ink channels 12 communicating with the respective ink ejection ports.

The inkjet recording head substrate 1 further includes an ink supply port (liquid supply port) 13 communicating with the ink channels 12 and a wiring pattern. FIG. 1 shows ink ejection pressure energy generating elements 2 that are elements for generating energy for ejecting ink and included in the wiring pattern.

In the following description, of the two oppositely disposed surfaces of the head substrate 1, the surface where the wiring is arranged is referred to as first surface (front surface) 1*a*, whereas the other surface is referred to as second surface (back surface) 1*b*. Likewise, of the two oppositely disposed surfaces of the silicon substrate (as indicated by reference symbol 10 in FIG. 2A) used as head substrates, the surface where a wiring pattern is formed is referred to as first surface (front surface) 10*a*, whereas the other surface is referred to as second surface (back surface) 10*b*.

Figure 2A:
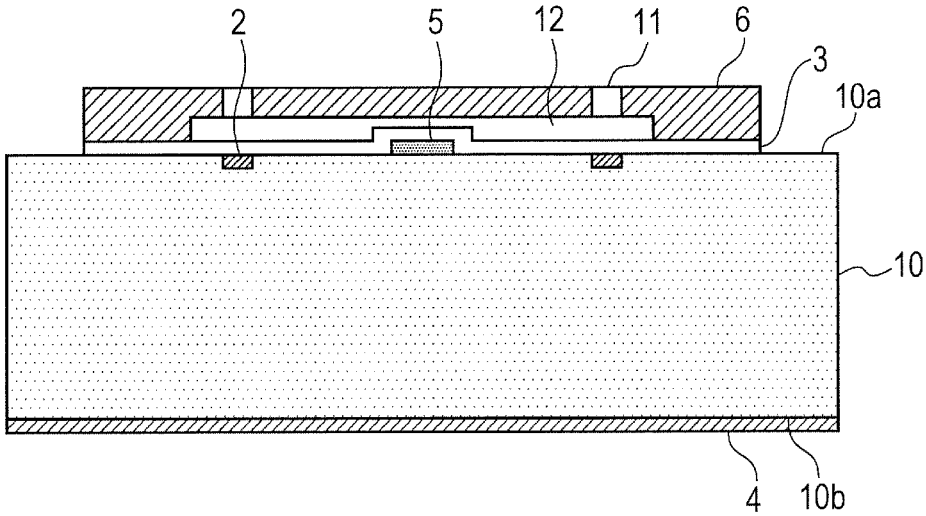
FIGS. 2A and 2B are schematic illustrations of an exemplar silicon substrate where liquid ejection ports and liquid channels are formed.

As shown in FIG. 1, the energy generating elements 2 are arranged in two rows at a predetermined pitch on the front surface of the substrate 1 and the ink supply port 13 is arranged between the two rows of the ink ejection pressure energy generating elements 2. Additionally, the ink ejection ports 11 are arranged above the respective ink ejection pressure energy generating elements 2 as shown in FIG. 2A.

According to the present invention, another layer may be arranged on the head substrate 1, between the head substrate 1 and the organic film layer 6 to be more specific. For example, a polyether amide layer may be formed as a tight adhesion layer.

The inkjet recording head 100 is arranged such that the surface thereof where the ink ejection ports 11 are formed faces the recording surface of a recording medium. As pressure is applied to the ink (liquid) that is filled into the ink channels 12 from the ink supply port 13 by the ink ejection pressure energy generating elements 2, ink droplets are ejected from the ink ejection ports 11. An image can be formed as the ejected ink droplets are forced to adhere to the recording medium. Note that an inkjet recording head prepared by using a head substrate according to the present invention can form not only images having meanings such as characters, figures and signs but also images having no particular meanings such as geometric patterns and so on.

The manufacturing method according to the present invention includes a step of forming an ink supply port running through a silicon substrate having a first surface and a second surface that are oppositely disposed all the way from the second surface to the first surface of the silicon substrate (a through hole forming step). Additionally, the manufacturing method according to the present invention involves preparation of a positioning reference mark, using a laser process, and hence does not require a process of preparing a positioning reference mark by patterning, using a photolithography process, unlike comparable known methods. Thus, according to the present invention, a positioning reference mark can be prepared with a smaller number of steps than ever and hence an ink supply port can be formed accurately in a short period of time. More specifically, an opening pattern is formed for an ink supply port in an etching mask layer 4 from the side of the second surface (from below the etching mask layer 4 in FIG. 2A) by means a laser, using a positioning reference mark prepared by using a laser process. The opening pattern of an ink supply port may be opening pattern grooves or such grooves and recesses as will be described hereinafter. Then, an ink supply port is formed from the opening pattern by means of crystal anisotropic etching.

Now, the steps of the manufacturing method according to the present invention will be described in detail below by referring to FIGS. 2A and 2B through FIGS. 7A and 7B. Note that FIGS. 2A, 3A, 4A, 6A and 7A are cross-sectional views taken along cutting line A-A' in FIG. 1, whereas FIGS. 2B, 3B, 4B, 6B and 7B are plan views of the back surface (second surface) of the silicon substrate 10. Also note that, in the plan views shown in FIGS. 2B, 3B, 4B, 6B and 7B, the vertical direction corresponds to the direction of the long edges (longitudinal direction) of the recording head substrate 1 shown in FIG. 1 but part of the silicon substrate is omitted from these drawings.

First, a wiring pattern is formed on the first surface 10*a* of the silicon substrate 10 (a wiring forming step) and an etching mask layer 4 is formed on the second surface 10*b*.

Ink ejection pressure energy generating elements 2, a sacrificial layer 5, an insulating protection layer 3, and an organic film layer 6 including ejection ports 11 and channels 12 are formed on the front surface 10*a* and an etching mask layer 4 is formed on the back surface 10*b* of the silicon substrate 10 shown in FIG. 2A. Ink ejection pressure energy generating elements 2 are arranged in two rows in the longitudinal direction (i.e., the direction perpendicular to the sheet) of the silicon substrate 10.

The wiring pattern typically includes ink ejection energy generating elements, wiring (not shown) for feeding electricity to the energy generating elements, an electric connector (not illustrated) for electrically connecting the head and the main body of an inkjet recording apparatus. The ink ejection pressure energy generating elements 2 can be formed by using wiring that is typically made of Al and a high resistance material that may typically be TaSiN or TaN. The wiring pattern may be formed by means of a photolithography process, for example. A heater may be arranged at the first surface 10*a*.

The sacrificial layer 5 may be formed on the front surface of the silicon substrate 10 in order to define the width of the opening of the ink supply port 13 at the front surface side. Materials that can be used for the sacrificial layer 5 include Al and AlSi, although the use of Al is efficient because the sacrificial layer 5 can be formed simultaneously with the wiring. The sacrificial layer 5 can typically be formed by means of a photolithography process.

The insulating protection layer 3 may be formed to cover the ink ejection pressure energy generating elements 2 and the sacrificial layer 5. The insulating protection layer 3 is typically made of SiO or SiN. The insulating protection layer 3 can take a role of protecting the wiring formed on the silicon substrate 10 against ink and other liquid and at the same time operating as etching stop layer when forming the ink supply port 13. The insulating protection layer 3 may be formed by means of a photolithography process.

A mold material (not illustrated) of positive photosensitive resin for producing a mold for the ink channels is formed on the insulating protection layer 3. The ink channels 12 are produced when the mold material is removed after forming the organic film layer 6 having the ink ejection ports 11. The mold material can be formed by laying a positive photosensitive resin layer by spin coating and patterning the layer by means of photolithography. The organic film layer 6 is formed by spin coating so as to cover the mold material and forming ejection ports and channels in the layer. Materials that can be used for the organic film layer 6 include negative photosensitive resin containing epoxy resin and a photo-cationic polymerization initiator.

The timing of forming the member (organic film layer 6) for producing ink channels can be selected appropriately. For example, the member may be formed on the front surface of the silicon substrate 10 after forming the mask layer 4 and before forming grooves 7 and recesses 8, which will be described hereinafter, or after forming the mask layer 4, the grooves 7 and the recesses 8.

The etching mask layer 4 may be formed as one or more than one layers on the back surface of the silicon substrate 10, using a material that is resistant to etching solutions (e.g., an aqueous solution of tetramethylammonium hydroxide). An insulating film typically made of SiO, an inorganic film that may be a metal film typically made of Mo, Au, TiN or Ti or an organic film made or polyether amide may be used for the etching mask layer 4. The use of a thermal oxide film of SiO for the etching mask layer 4 can reduce the manufacturing time because then the etching mask layer 4 can be formed simultaneously with the insulating protection layer 3 on the front surface. The etching mask layer 4 can be formed by means of a photolithography process. Additionally, the etching mask layer 4 can be formed so as to cover the back surface of the substrate. The timing of forming the mask layer 4 can be appropriately selected so long as the process of forming the mask layer 4 is executed in a manufacturing stage before forming the ink supply port. The silicon substrate having such a mask layer 4 on the back surface 10*b* thereof can be used in the mark forming step, which will be described hereinafter.

Then, a positioning reference mark 9 is formed on the etching mask layer 4 on the second surface from the side of the second surface by means of a laser as shown in FIGS. 3A and 3B through 5 (a mark forming step).

While any laser that can be used in the field of recording heads may be used for forming the mark 9, the use of the second harmonic (wavelength: 532 nm) of a $YVO_4$ laser (wavelength: 1064 nm) is preferable from the viewpoint of the transmittance of the silicon substrate 10. Then, while the laser machining conditions can be appropriately regulated according to the mark 9 to be formed, the frequency of the laser is preferably not lower than 15 kHz from the viewpoint of suppressing generation of debris (scattering objects produced by the machining) and the output power is preferably not less than 0.3 W from the viewpoint of contrast.

The positioning reference mark 9 is formed as a hollow that runs through the etching mask layer 4 and has a bottom at the back surface 10*b* in FIGS. 3A and 3B through 5. However, the shape of the positioning reference mark can appropriately be selected. For example, the positioning reference mark 9 may alternatively be formed as a hollow that runs through the etching mask layer 4 and has a bottom in the inside of the substrate 10. Furthermore, the shape of the opening of the mark 9 may take any appropriate form. For example, the opening may be formed as a cross as shown in FIGS. 3A and 3B through 5 or a quadrangle.

The machining depth of the mark 9, that of the opening pattern grooves and that of recesses, which will be described hereinafter, may appropriately be adjusted depending on the laser species and the output conditions of the laser. The same laser species and the same output conditions may be used for forming these hollows. Alternatively, different laser species and different output conditions may be used for the hollows.

Figure 2B:
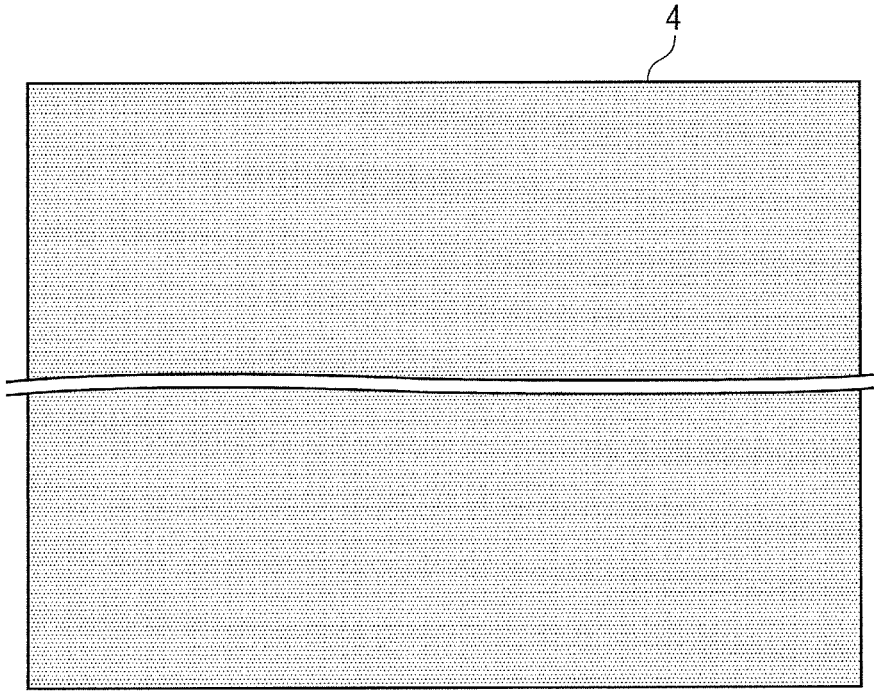
Figure 3A:
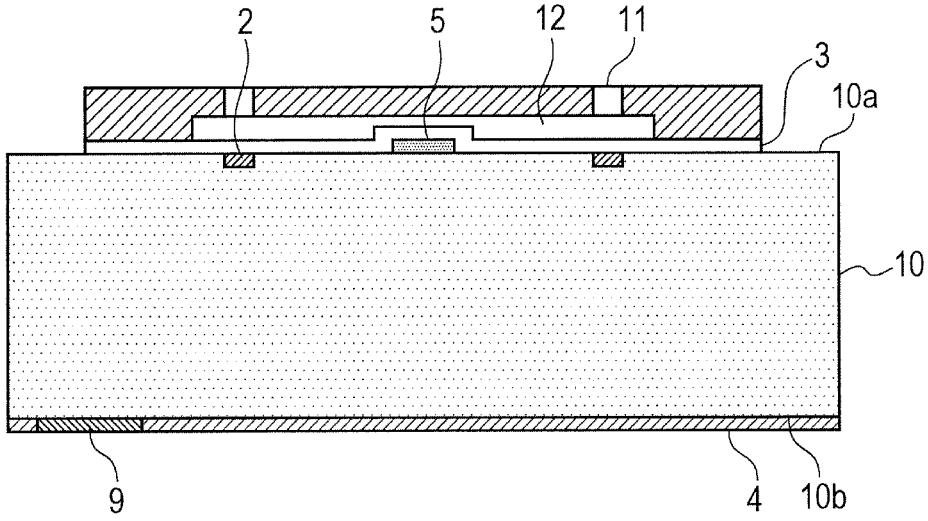
FIGS. 3A and 3B are schematic illustrations of a silicon substrate, illustrating an exemplar position for forming a positioning reference mark.
Figure 3B:
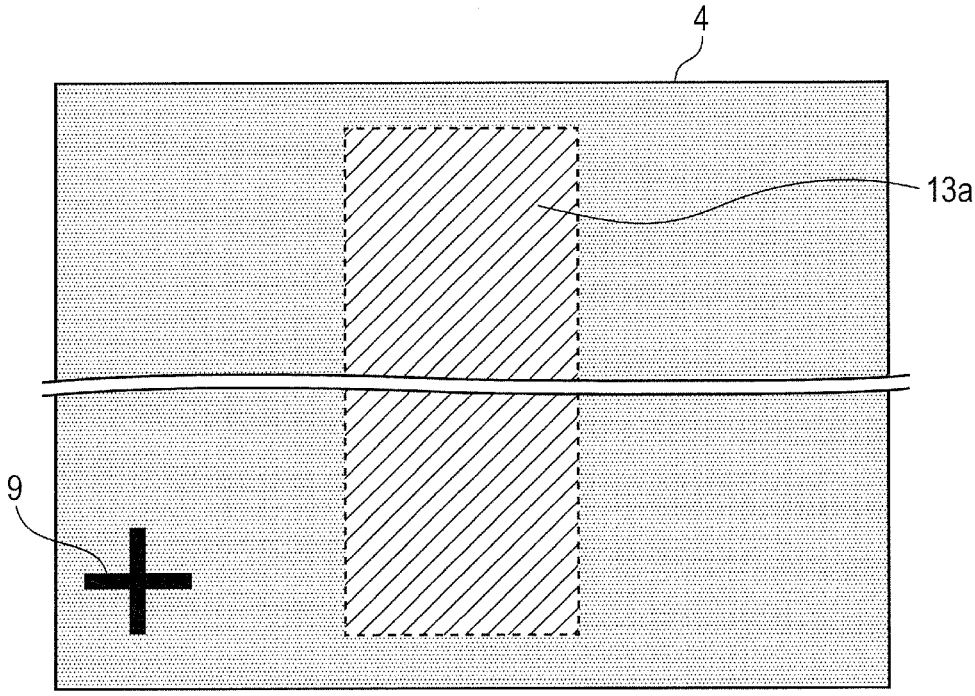

The position for forming the mark 9 can also appropriately be selected. For example, in FIG. 3B, a mark 9 is formed near the region 13*a* for forming the ink supply port at the back surface of the silicon substrate, in a lower left part of the etching mask layer 4 in the drawing to be more specific. While FIGS. 1 through 4A and 4B and FIGS. 6 and 7 are drawn to attract attention to a single chip (inkjet recording head), a mark 9 may alternatively be formed in the region for forming a chip on the second surface of the silicon substrate and in the region other than the region 13*a* for forming the ink supply port as shown in FIG. 3B.

Figure 5:
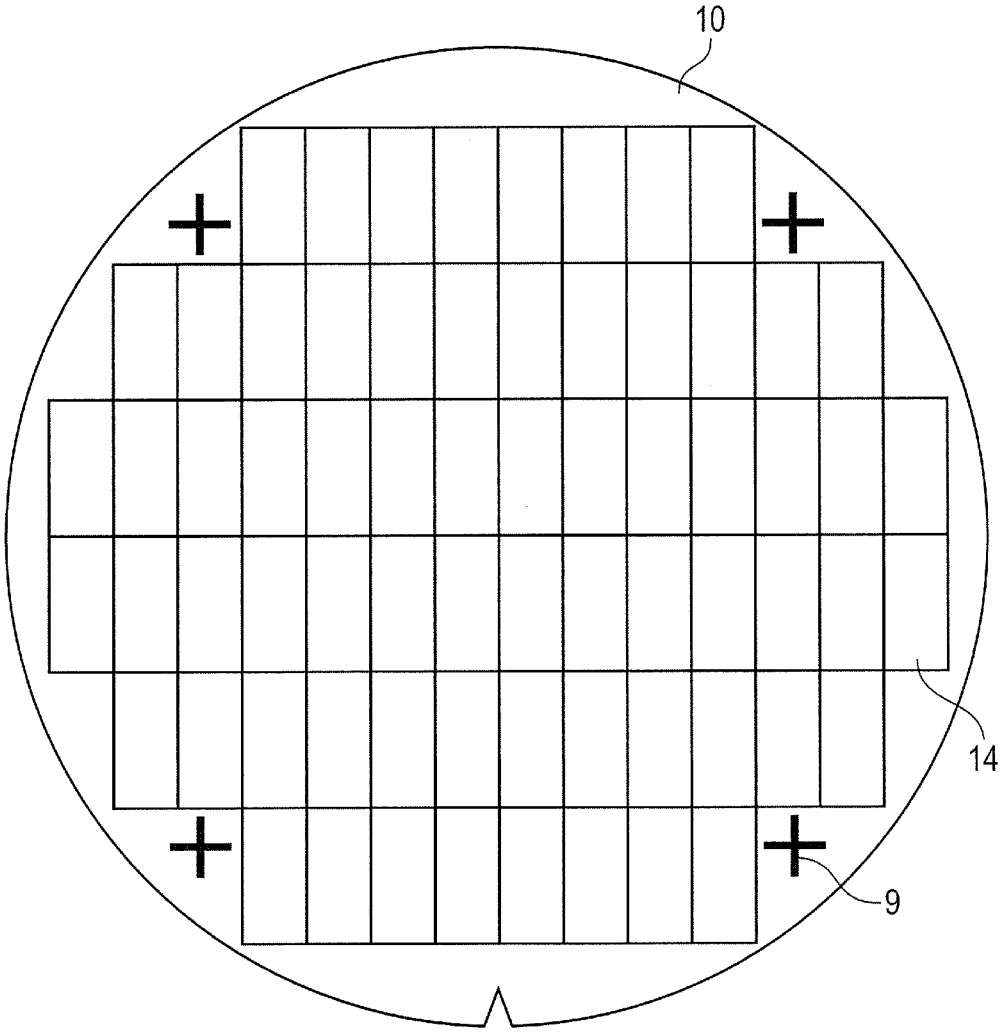
FIG. 5 is a schematic illustration of a silicon substrate, illustrating still another exemplar positions for forming a positioning reference mark.

One or more than one positioning reference marks 9 may be formed in regions other than the region 14 for forming chips on the back surface of the wafer 10 as shown in FIG. 5.

Note that the region for forming chips on the second surface of the silicon substrate agrees with the region for forming inkjet recording head substrates on the second surface of the silicon substrate. In other words, when a number of head substrates, each having an ink supply port, are manufactured from a single silicon substrate, one or more than one marks 9 may be formed in regions other than the region 14 for forming head substrates on the second surface of the silicon substrate or, alternatively, in the regions for forming head substrates and in regions other than the regions for forming ink supply ports on the second surface of the silicon substrate.

Figure 4A:
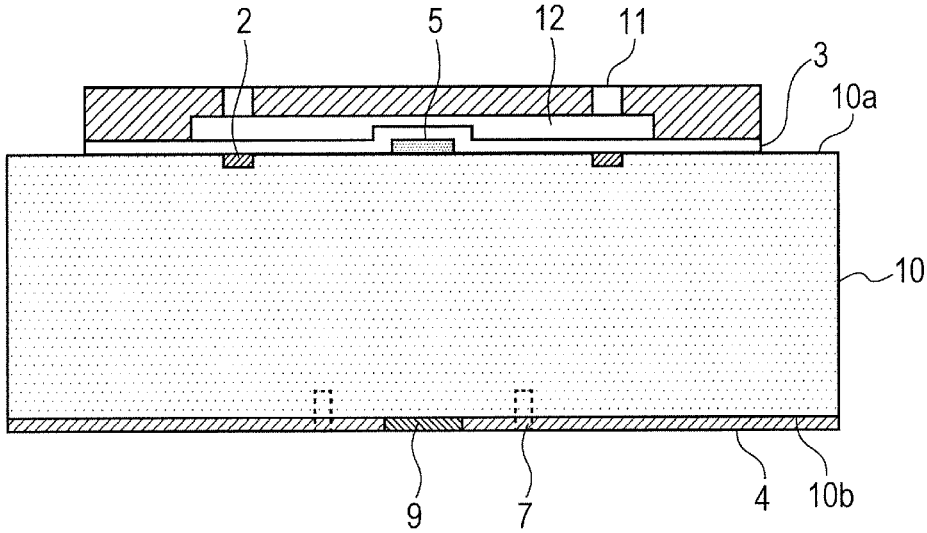
FIGS. 4A and 4B are schematic illustrations of a silicon substrate, illustrating another exemplar position for forming a positioning reference mark.
Figure 4B:
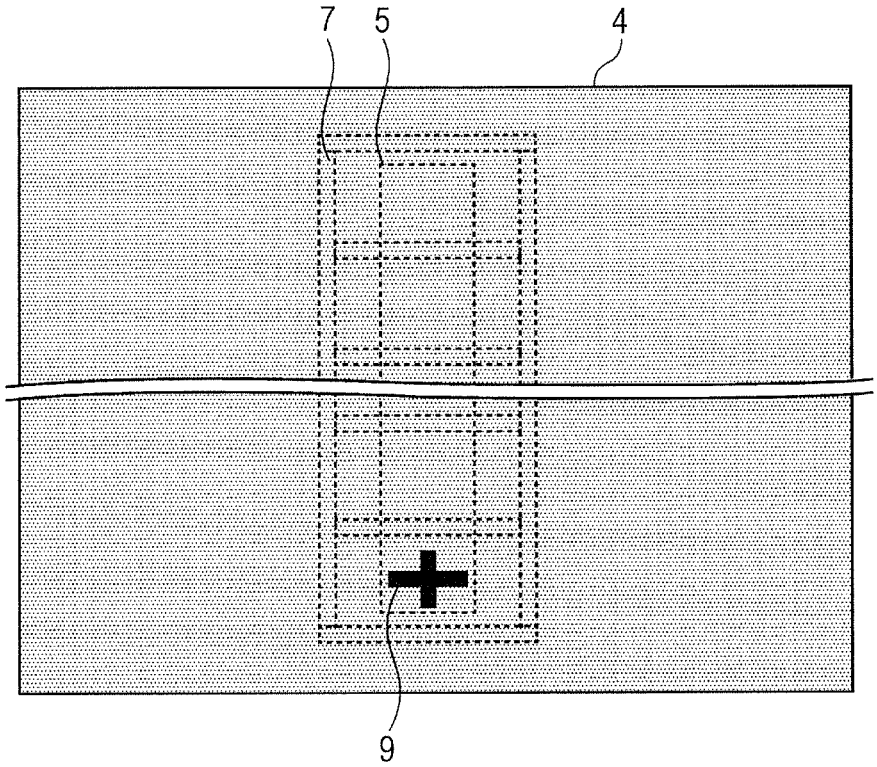

Still alternatively, a mark 9 may be formed in the region for forming an ink supply port (denoted by symbol 13*a* in FIG. 3B) on the back surface 10*b*. In FIG. 4B, a mark 9 is formed in this region on the back surface at a position located opposite to the sacrificial layer 5 formed on the front surface. When a mark 9 is formed in the region 13*a*, opening pattern grooves 7 can be formed to surround the mark 9 in a subsequent step. This positional arrangement provides an advantage that a region for forming a positioning reference mark 9 does not need to be exclusively defined in advance on the substrate and hence all the surface area of the substrate can effectively be exploited because the positioning reference mark 9 is eliminated from the substrate when an ink supply port 13 is formed. In FIG. 4B, the sacrificial layer 5 and the opening pattern grooves 7 to be formed in a subsequent step are indicated by dotted lines.

Figure 6A:
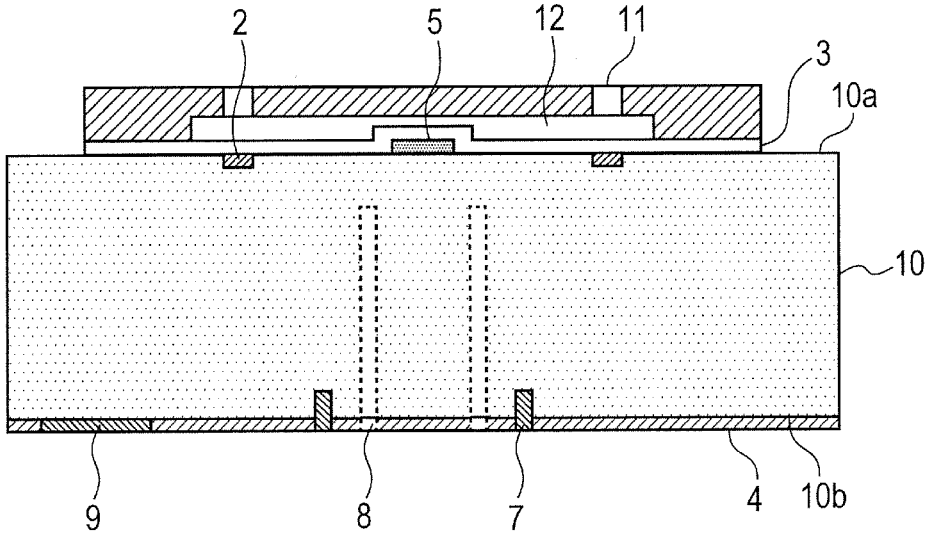
FIGS. 6A and 6B are schematic illustrations of an exemplar silicon substrate after forming recesses and opening pattern grooves.
Figure 6B:
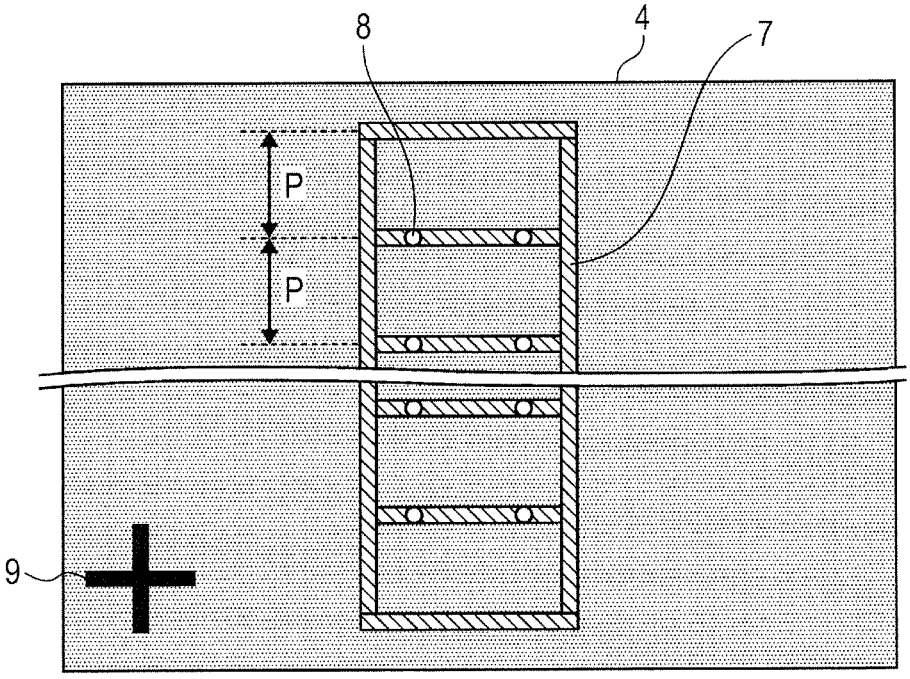
Figure 7A:
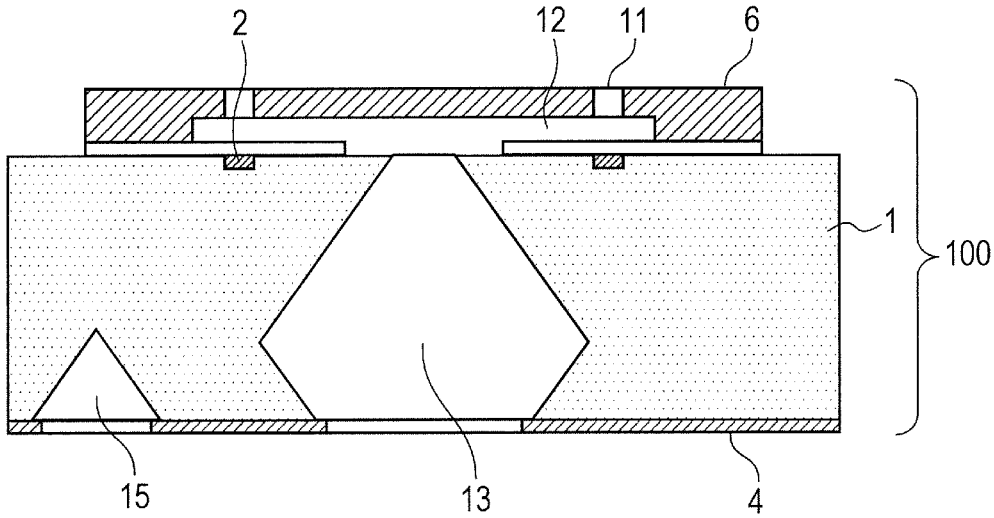
FIGS. 7A and 7B are schematic illustrations of an exemplar silicon substrate where a liquid supply port is formed.
Figure 7B:
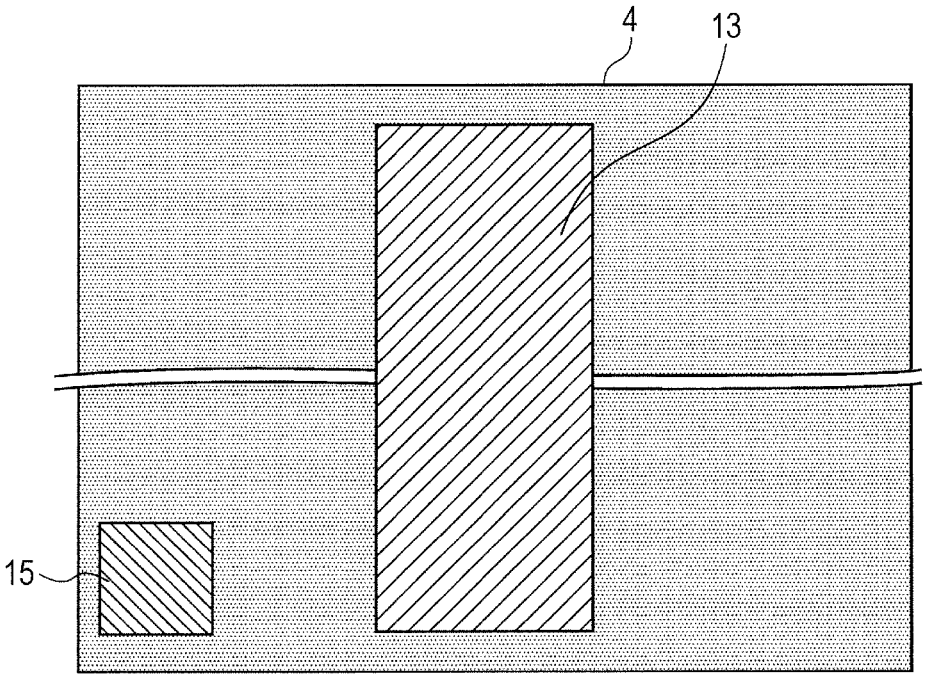

It should be noted that the position for forming a mark 9 is the one indicated in each of FIGS. 3B, 4B, 6B and 7B and the mark 9 shown in each of FIGS. 3A, 4A, 6A and 7A does not tell that the mark 9 is formed at the cross section A-A'. Likewise, the positions for forming recesses 8 shown in FIGS. 6A and 6B and the position for forming a hollow 15 shown in FIGS. 7A and 7B are those indicated respectively in FIGS. 6B and 7B and the recesses 8 and the hollow 15 shown respectively in FIGS. 6A and 7A do not tell that they are formed at the cross section A-A'.

According to the present invention, when forming a mark 9, a positioning reference mark may be formed separately in advance on the front surface 10*a* and then the mark 9 can be formed on the back surface 10*b* by referring to the mark on the front surface. Such a mark can be formed on the front surface by photolithography process. In FIGS. 4A and 4B, a positioning reference mark (not shown) is formed in advance in the inside of the sacrificial layer 5 on the front surface and a mark 9 is formed in the region for forming an ink supply port (for forming an opening) on the back surface by referring to the reference mark. Thus, the position for forming a mark 9 is located close to the position of the positioning reference mark to allow a mark 9 to be formed highly accurately at the position on the back surface located right opposite to the sacrificial layer 5.

Subsequently, opening pattern grooves running through the etching mask layer on the back surface 10*b* and having a bottom in the inside of the silicon substrate are formed by a laser and by referring to the mark 9 that operates as positioning reference mark (a laser machining step).

In FIGS. 6A and 6B, recesses 8, which will be described hereinafter, and opening pattern grooves 7 are formed in the silicon substrate 10. More specifically, as shown in FIG. 6B, opening pattern grooves 7 are formed in an area of the etching mask layer 4 that corresponds to the ink supply port as hollows that run through the etching mask layer 4 and have a bottom in the inside of the substrate 10.

In the laser machining step, for example, the third harmonic (wavelength: 355 nm) of a YAG laser (wavelength:

1,064 nm) that shows an excellent absorptance relative to silicon can be employed as a laser species.

Then, the laser for forming the grooves 7 preferably has a frequency not lower than 30 kHz and an output power not less than 4.0 W.

An appropriate shape can be selected for the opening pattern grooves 7 according to the shape of the opening of the ink supply port 13. For example, the shape of the opening of the grooves 7 may be made to agree with the shape of the opening of the ink supply port or the opening pattern grooves 7 may be formed as lattice as shown in FIG. 6B. When lattice shaped grooves 7 (lattice pattern) are employed, the laser machining time in the laser machining step and the etching rate in the etching step, which will be described hereinafter, can be made to be variable as a function of the pitch of arrangement of grooves 7 in the longitudinal direction of the silicon substrate 10. In other words, the laser machining time is prolonged but the etching time is shortened as the pitch of arrangement of grooves 7 is reduced. Therefore, from the viewpoint of making the etching rate substantially equal to that of comparable conventional methods, the pitch P of arrangement of grooves 7 in the longitudinal direction of the substrate is preferably not more than 800 μm. On the other hand, from the viewpoint of machining tact, the pitch P of arrangement of grooves is preferably not less than 200 μm.

According to the present invention, the step of forming opening pattern grooves (the laser machining step) may include a step of forming recesses in the region for forming an ink supply port on the silicon substrate. Recesses refer to hollows running through the etching mask layer on the second surface (back surface) and having a bottom located closer to the first surface (front surface) than the bottoms of the opening pattern grooves in the inside of the silicon substrate.

The region for forming the ink supply port of the silicon substrate is made to agree with the region of the ink supply port of the head substrate and can include the regions of the grooves 7 and the regions surrounded by the grooves 7. For example, the recesses may be formed in the regions surrounded by the opening pattern grooves 7 of the back surface 10*b* and the arrangement and the number of recesses are not subjected to any particular limitations.

In FIG. 6B, recesses 8 that run through the etching mask layer 4 but are not through holes in the silicon substrate 10 with their closed ends located in the inside of the silicon substrate 10 are arranged on the lattice-shaped grooves 7 in two rows in the longitudinal direction of the silicon substrate 10. According to the present invention, recesses 8 are preferably arranged at positions located on the opening pattern grooves 7 as shown in FIG. 6B. With this arrangement, the etching solution can easily get into the recesses 8 in the etching step, which will be described hereinafter, and the operation of anisotropic etching can proceed quickly.

Recesses 8 can be formed by means of the technique described below. Recesses can be formed by controlling the recess machining positions, using a mark 9, and irradiating a laser beam to each of the intended positions.

Then, an ink supply port that runs through the silicon substrate is formed by means of crystal anisotropic etching of the silicon substrate from the opening pattern grooves to the front surface (the etching step).

The operation of crystal anisotropic etching can be executed by making the etching solution, which may typically be an aqueous solution of TMAH (tetramethylammonium hydroxide), fill the opening pattern grooves 7. For this operation, a protection material is preferably laid on the organic film layer 6 in order to protect the organic film layer. When recesses are formed in the silicon substrate, the silicon substrate can be etched by crystal anisotropic etching from the recesses 8 and the grooves 7 to the front surface after filling the recesses 8 and the grooves 7 with the etching solution.

In FIGS. 7A and 7B, an ink supply port 13 is formed by the operation described below. Firstly, a through hole that extends from the etching mask layer 4 to the sacrificial layer 5 is formed by crystal anisotropic etching. Thereafter, the part of the insulating protection layer 3 that covers the opening region of the ink supply port 13 is removed by dry etching to produce the ink supply port. In FIGS. 7A and 7B, the positioning reference mark formed on the back surface of the silicon substrate is also etched out in the crystal anisotropic etching operation and a hollow 15 that runs through the etching mask layer 4 and has a bottom in the inside of the substrate is also formed at the part where the mark was formed. The mark 9, the opening pattern grooves 7, the recesses 8 and the hollow 15 may have flat bottoms as shown in FIG. 6A or bottoms that are not flat like the hollow 15 shown in FIG. 7A.

The insulating protection layer 3 can be removed simultaneously with the sacrificial layer at the time of completion of the crystal anisotropic etching operation by appropriately regulating the thickness of the insulating protection layer 3 according to the etching time. Thereafter, the protection material (not shown) and the mold material (not shown) are removed.

A substrate 1 (inkjet recording head 100) in which a nozzle section for ejecting ink flowing in from the ink supply port 13 out of the ink ejection ports 11 is formed can be obtained by way of the above-described steps. Note that, according to the present invention, a chip tank member for feeding ink may be bonded to the recording head after bonding electric wiring to a main body for driving the ink ejection pressure energy generating elements 2. When a number of chips are formed on a single silicon substrate, electric wiring and a chip tank member can be bonded to each of the chips after cutting the silicon substrate by means of a dicing saw and separating the chips.

Thus, according to the present invention, a positioning reference mark can be formed with a few number of steps by forming such a positioning reference mark by means of a laser and hence a liquid supply port can be produced accurately in a short period of time.

While a number of chips are produced from a single silicon substrate in actuality, preparation of a single chip will be described in the examples that will be described below.

EXAMPLE 1

A wiring pattern that included a heater was formed on the front surface 10*a* of a silicon substrate 10. More specifically, ink ejection pressure energy generating elements 2 and an ink-resistant protection film (not shown) were formed for the wiring pattern. Subsequently, a sacrificial layer 5 of AlSi and an insulating protection layer 3 of SiO were formed. Thereafter, an etching mask layer 4 of $SiO_2$ was formed on the back surface 10*b*. Then, a tight adhesion layer (not shown) of polyether amide was formed on the part of the insulating protection layer where ink channel walls was to be formed by way of a photolithography process. Subsequently, a mold material (not shown) for forming ink channels was prepared by applying positive photosensitive resin ODUR (tradename, available from Tokyo Ohka Kogyo) to both the insulating protection layer and the tight adhesion layer and patterning the prepared mold material by means of photolithography. Thereafter, an organic film layer 6 was laid on the mold material and the tight adhesion layer to form walls of ink ejection ports 11 and those of ink channels. One hundred mass portions of epoxy resin EHPE3150 (tradename, available from DAICEL) and 6 mass portions of photocationic polymerization catalyst SP-172 (tradename, available from ADEKA) were used as materials of the organic film layer 6. Then, ink ejection ports 11 and ink channels 12 were formed by way of a photolithography process. Then, a protection material (not illustrated) for protecting the organic film layer 6 against etching solution was formed so as to cover the organic film layer 6. As a result, a silicon substrate 10 as shown in FIGS. 2A and 2B was obtained.

Subsequently, a positioning reference mark 9 having a cross-shaped opening that is a hollow running through the mask layer 4 and having a bottom at the back surface was formed by means of the second harmonic of a $YVO_4$ laser, using a laser machining apparatus (Osprey 4.0: tradename, available from Excel). More specifically, the mark 9 was formed at the position indicated in FIG. 3B (in a region other than the region 13*a* for forming an ink supply port). The laser machining conditions included a frequency of 20 kHz, an output power of 0.40 W and a scanning rate of 50 mm/sec.

Then, lattice-shaped opening pattern (lattice pattern) grooves 7 as shown in FIG. 6B were formed in the etching mask layer 4 at the part corresponding to the ink supply port 13 (region 13*a*) by using the mark 9 and the third harmonic (wavelength: 355 nm) of a YAG laser as a laser species. The laser machining conditions for this operation included an output power of 4.5 W and a frequency of 30 kHz. The grooves 7 were formed so as to run through the etching mask layer 4 and get to a depth of about 10 μm from the back surface 10*b* of the silicon substrate 10. The pitch P of arrangement of the grooves 7 in the longitudinal direction of the silicon substrate 10 in FIG. 6B was made to be equal to 800 μm as a result of taking the etching rate and the laser machining time into consideration.

Subsequently, recesses 8 that ran through the etching mask layer 4 but were not through holes in the silicon substrate 10 with their closed ends located in the inside of the silicon substrate 10 were formed at positions overlapping parts of the opening pattern grooves 7 in two rows in the longitudinal direction of the silicon substrate by means of the third harmonic of a YAG laser (wavelength: 355 nm).

Then, the substrate 10 was immersed in an aqueous solution of TMAH (tetramethylammonium hydroxide) for 1,080 minutes to etch from the opening pattern grooves 7 and the recesses 8 to the sacrificial layer 5 by crystal anisotropic etching. Thereafter, the part of the insulating protection layer covering the region of the opening of the ink supply port at the front surface of the substrate 10 was removed by dry etching to produce the ink supply port 13. Then, the protection material and the mold material were removed by methyl lactate to obtain an inkjet recording head substrate 1.

Subsequently, electric wiring (not shown) for driving the ink ejection pressure energy generating elements 2 was bonded to the inkjet recording head substrate 1 and then a chip tank member (not shown) for feeding ink was bonded to the substrate 1. As a result, an inkjet recording head 100 was obtained.

COMPARATIVE EXAMPLE 1

An inkjet recording head 100 was prepared as in Example 1 except that a photolithography process was employed to form a positioning reference mark 9 on the etching mask layer 4.

In Example 1, as a result of forming positioning reference marks by means of a laser, the time of preparing inkjet recording heads could be reduced by 240 minutes per lot from Comparative Example 1 where photolithography was employed. Thus, the present invention provides a method of manufacturing a liquid ejection head substrate that can form positioning reference marks with a reduced number of steps and accurately produce a liquid supply port in a short period of time even a silicon substrate having an inorganic material layer on the back surface (the second surface) is employed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-166494, filed Jul. 29, 2011, which is hereby incorporated by reference herein in its entirety.

What is claimed is:

1. A method of manufacturing a liquid ejection head substrate including a step of forming a liquid supply port extending from a second surface to a first surface of a silicon substrate, the first surface and the second surface being oppositely disposed, the method comprising:

a step of forming a wiring pattern on the first surface;

a step of forming an etching mask layer on the second surface;

a mark forming step of forming a positioning reference mark on the etching mask layer by means of a laser from above the etching mask layer on the second surface;

a laser machining step of forming an opening pattern groove running through the etching mask layer on the second surface and having a bottom in the inside of the silicon substrate, using the positioning reference mark; and a step of forming a liquid supply port running through the silicon substrate by etching the silicon substrate from the opening pattern groove to the first surface by means of crystal anisotropic etching.

2. The method according to claim 1, wherein the laser for forming the positioning reference mark is the second harmonic of a $YVO_4$ laser.

3. The method according to claim 1, wherein the frequency and the output power of the laser for forming a positioning reference mark are respectively not less than 15 kHz and not less than 0.3 W.

4. The method according to claim 1, wherein the laser machining step includes a step of forming a recess running through the etching mask layer on the second surface and having a bottom located closer to the first surface than the bottom of the opening pattern groove in the inside of the silicon substrate in a region surrounded by the opening pattern groove.

5. The method according to claim 1, wherein a number of liquid ejection head substrates, each having a liquid supply port, are manufactured from a single silicon substrate and, at the time of manufacturing a number of liquid ejection head substrates, the positioning reference mark is formed in a region on the second surface of the silicon substrate other than the region for forming the liquid ejection head substrate.

6. The method according to claim 1, wherein a positioning reference mark is formed in the region for forming a liquid supply port on the second surface of the silicon substrate.

7. The method according to claim 1, wherein a number of liquid ejection head substrates, each having a liquid supply port, are manufactured from a single silicon substrate and, at the time of manufacturing a number of liquid ejection head substrates, the positioning reference mark is formed in a region on the second surface of the silicon substrate other than the region for forming the liquid supply port in the region for forming the liquid ejection head substrate.

* * * * *